United States Patent [19]

Han et al.

[11] 4,115,782

[45] Sep. 19, 1978

[54] MICROWAVE ANTENNA SYSTEM

[75] Inventors: Ching C. Han, Sunnyvale; Harry J. Gould, Cupertino, both of Calif.

[73] Assignee: Ford Motor Company, Dearborn, Mich.

[21] Appl. No.: 698,254

[22] Filed: Jun. 21, 1976

[51] Int. Cl.[2] ..... H01Q 19/14; H01Q 19/12

[52] U.S. Cl. ..... 343/779; 343/840; 343/781 P

[58] Field of Search ..... 343/756, 786, 840, 781, 343/779; 333/9

[56] References Cited

U.S. PATENT DOCUMENTS

| | | | |
|---|---|---|---|
| 3,140,491 | 7/1964 | Ashbaugh | 343/840 |
| 3,599,219 | 8/1971 | Holtum | 343/840 |
| 3,680,143 | 7/1972 | Ajioka | 343/779 |
| 3,696,435 | 10/1972 | Zucker | 343/840 |
| 3,958,193 | 5/1976 | Rootsey | 333/9 |

*Primary Examiner*—Alfred E. Smith
*Assistant Examiner*—Harry E. Barlow
*Attorney, Agent, or Firm*—Robert W. Brown; Clifford L. Sadler

[57] ABSTRACT

An antenna for use in propagating or receiving microwave radiation having both left-hand and right-hand circular polarization. The left-hand and right-hand circularly polarized radiation may be transmitted or received simultaneously without interference with one another, that is, they are isolated from one another by 27 dB or more. The preferred antenna comprises an array of closely clustered waveguide elements each of which converts respective linearly polarized signals to left-hand and right-hand circularly polarized signals and vice versa. Isolation means also are provided in each of the waveguide elements for preventing radiation either propagated or received by a waveguide element from being coupled into the radiation being propagated or received by other waveguide elements in the array. Preferably, square waveguide is utilized for the array elements and the isolation is provided by a plurality of conductive elements mounted on each of the open ends of the waveguide elements. The cluster array of waveguide elements may include dummy elements, may be fed with electromagnetic signals having various phase and power differences to produce desired radiation transmission or reception patterns and may be used to illuminate a parabolic reflector having a secondary radiation pattern. A single waveguide element or an array of them may be used in communications satellites and the like or may be used in radar or other applications.

11 Claims, 17 Drawing Figures

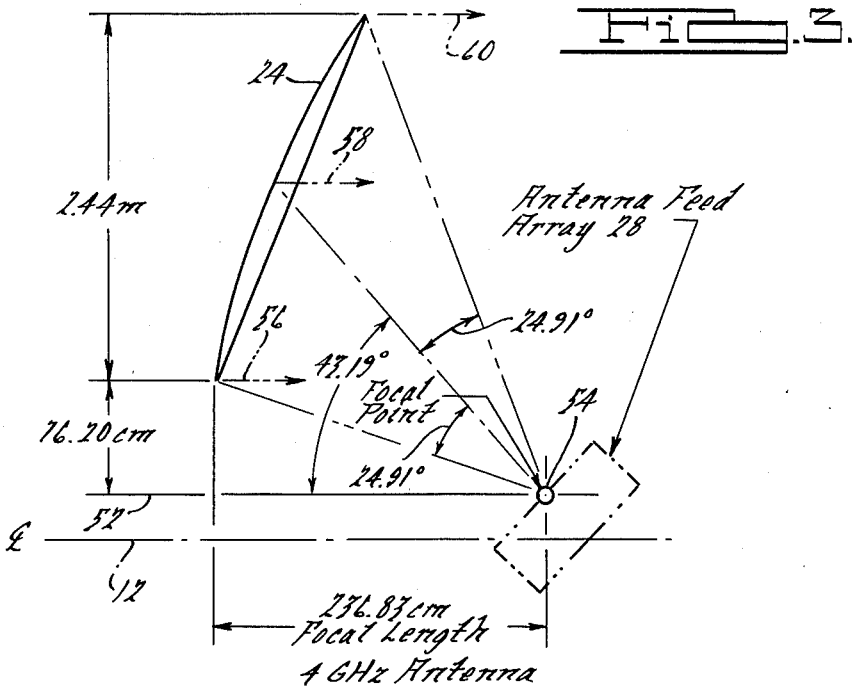
FIG. 4.
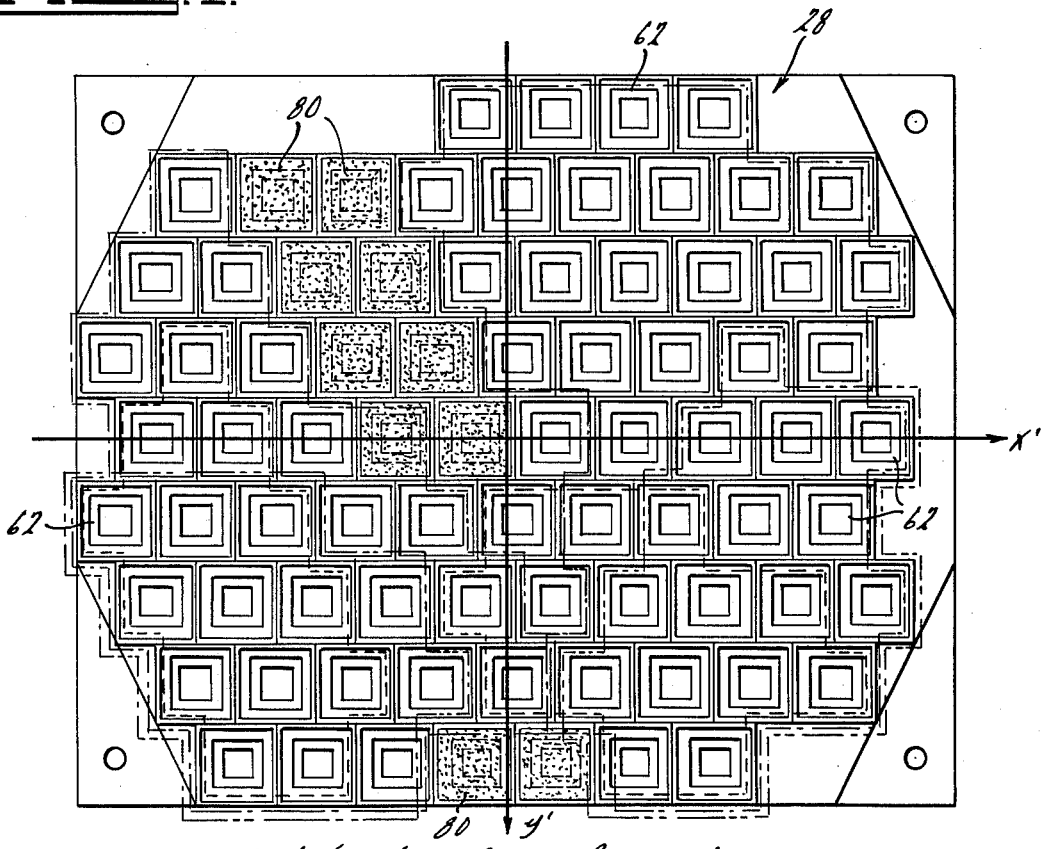
- - - - - - Zone Feeds (Indian Ocean Coverage)
——— Hemi Feeds
—·· —— Zone Feeds (Atlantic And Pacific Ocean Coverage)

FIG. 9.
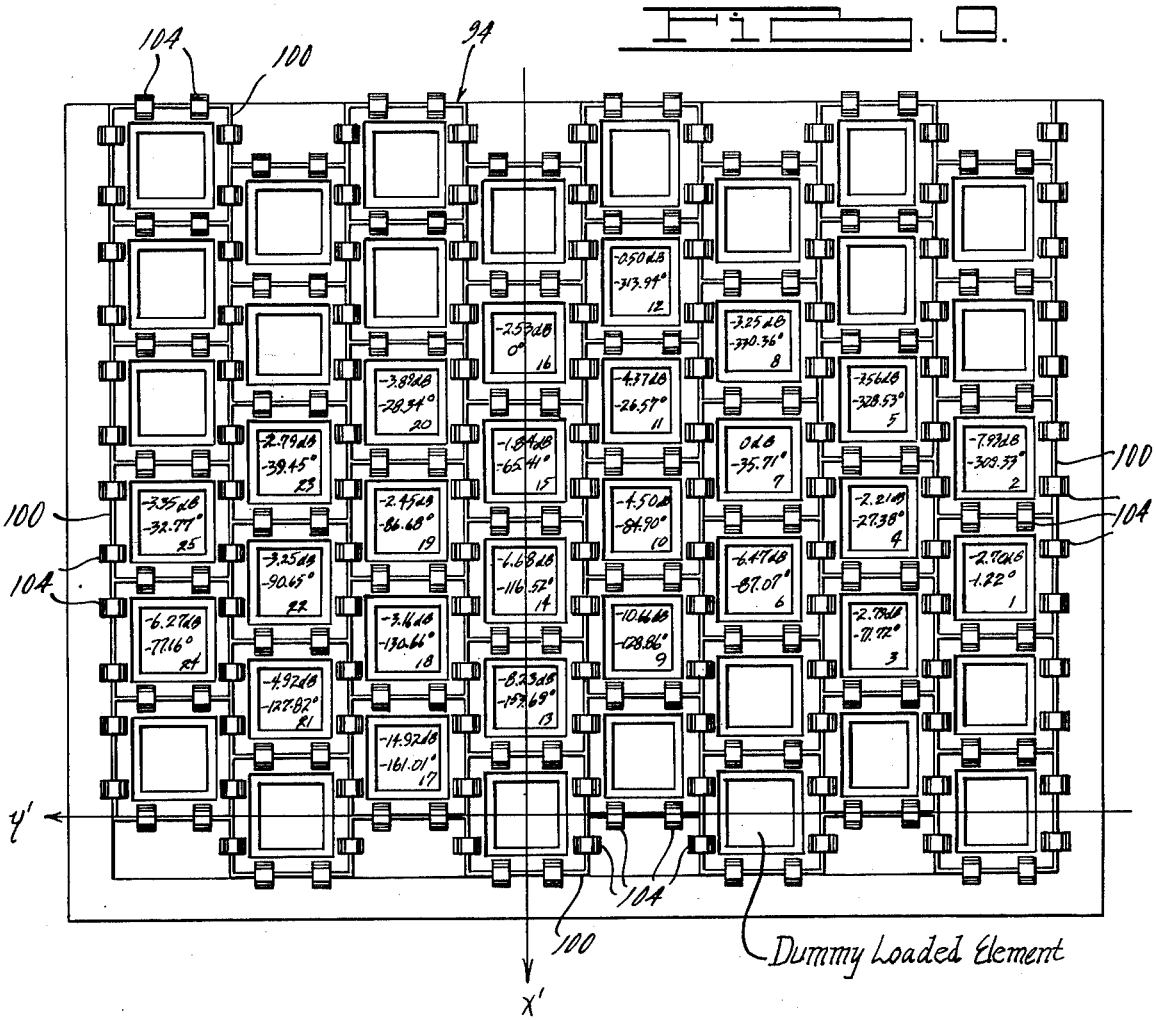
FIG. 10.
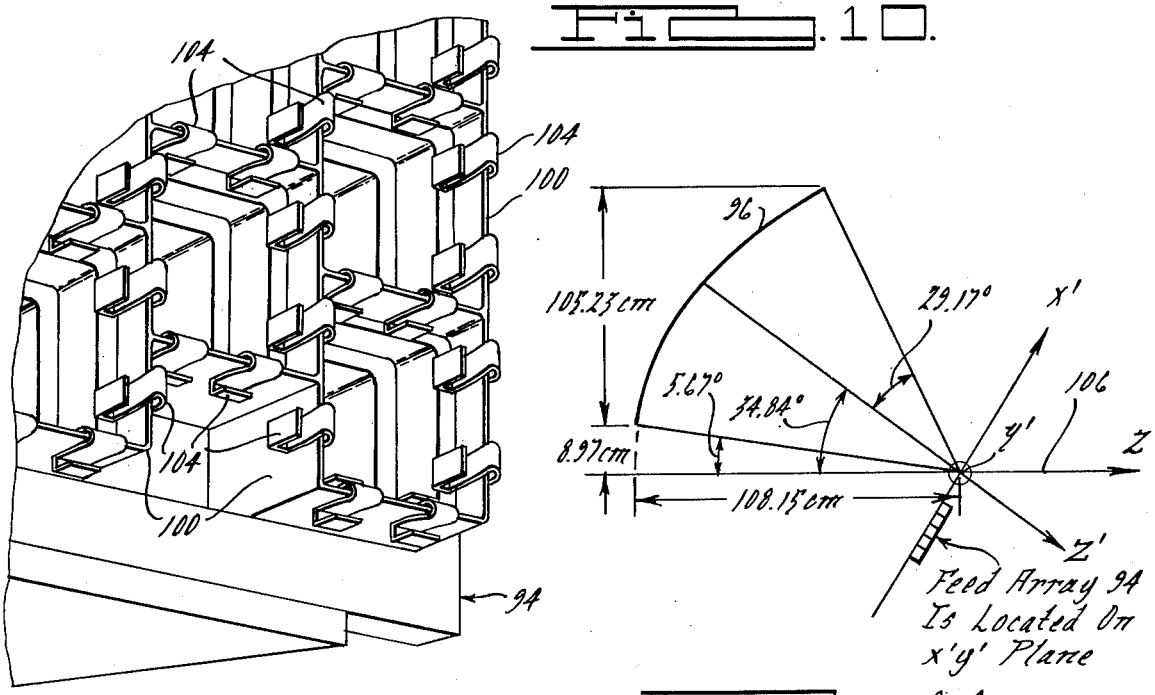
FIG. 11.

Contour Data
(Freq. = 9.54 GHz)

| Symbol | Level |
|---|---|
| A | 0.000 |
| B | -1.000 |
| C | -2.000 |
| D | -3.000 |
| E | -4.000 |
| F | -5.000 |
| G | -6.000 |
| H | -10.000 |
| I | -15.000 |
| J | -21.000 |
| K | -27.000 |
| L | -30.000 |
| M | -35.000 |
| N | -40.000 |

Contour Data
(Freq. = 9.54 GHz)

| Symbol | Level |
|---|---|
| A | 0.000 |
| B | -1.000 |
| C | -2.000 |
| D | -3.000 |
| E | -4.000 |
| F | -5.000 |
| G | -10.000 |
| H | -20.000 |
| I | -30.000 |

MICROWAVE ANTENNA SYSTEM

BACKGROUND OF THE INVENTION

This invention relates to a microwave antenna system. More particularly, the invention relates to an antenna system suitable for use in propagation and reception of electromagnetic radiation at microwave frequencies, that is, at frequencies wherein waveguide can be utilized in the transmission or reception of electromagnetic radiation. For the purposes of the present invention, the term "antenna" means a device used with a transmitter for the purpose of radiating into free space (including the earth's atmosphere) periodic electromagnetic radiation or for receiving from free space such electromagnetic radiation. The antenna of the invention is particularly suitable for use in communications satellite applications and also may be used in radar or other applications.

Communications satellites are maintained in a synchronous orbit which is a substantially circular orbit about the surface of the earth and at an altitude and with a velocity parallel with the earth's surface such that the satellite does not substantially change in position relative to a particular point on the surface of the earth. In other words, although the satellite has an orbital velocity, the surface of the earth also is rotating and the angular velocity of the satellite may be made to correspond to that of the earth's surface, thereby, resulting in no relative movement of the satellite with respect to a point on the earth's surface. If this sub-satellite point is located in one of the oceans, such as the Atlantic ocean, antennas mounted on the satellite may be used to receive electromagnetic radiation from, for example, the easterly continent or hemisphere and may be used to retransmit this received radiation, at a different frequency, to receiving stations located in the westerly continent or hemisphere.

The transmission and reception by the satellite is accomplished typically with microwave electromagnetic frequencies modulated as required to convey information between remotely located points on the earth's surface or to transmit to various earth locations information accumulated by equipment aboard the satellite. In the transmission from and reception by the satellite of electromagnetic radiation, a suitable antenna is positioned at or near the focal point of a reflector to obtain an antenna system having high directivity toward, for example, the western hemisphere and a high degree of isolation of this westerly beam with respect to the radiation reflected from the reflector toward the easterly hemisphere. The reflector typically is parabolic in form and may be of the offset parabolic type wherein the antenna system includes a radiation propagating feed source located at the focal point of a usually elliptical portion of the paraboloid surface. The radiation feed arrangement illuminates this elliptical portion of the paraboloid surface, which, in turn, reflects the radiation toward the earth. Preferably, the elliptical portion of the paraboloid surface is offset from the focal point at which the feed device is located so that the feed device does not interfere with the electromagnetic radiation either being received by or transmitted from the reflector portion of the antenna system.

Publications describing satellites, antenna systems using offset and parabolic reflectors, and feed arrangements that may be utilized are available and reference is made to these should further background information be desired.

SUMMARY OF THE INVENTION

The invention provides an antenna system comprising a single waveguide element or an array of waveguide elements suitable for use in propagating into space or for receiving from space electromagnetic radiation at microwave frequencies. The term "microwave frequencies" as used herein designates those frequencies in the electromagnetic spectrum at which the employment of waveguide transmission lines is feasible.

In the preferred form of the invention, an antenna system comprises a plurality of waveguide elements arranged in a closely packed cluster. The waveguide elements are arranged so that they have parallel electromagnetic radiation propagation directions. Corresponding ends of each of the waveguide elements include means for coupling thereto or therefrom electromagnetic radiation of microwave frequency and means for converting such microwave frequency radiation from the linearly polarized form to the circularly polarized form or vice versa. The corresponding opposite ends of each of the waveguide elements are open to permit radiation to be propagated therefrom into space or to permit radiation in space to be received by the waveguide elements at their open ends. Also, isolation means are provided at or near the open end of each of the waveguide elements for preventing radiation emanating therefrom or entering therein from being coupled to radiation emanating from or entering nearby waveguide elements. The isolation means tends to equalize the intensity of the orthogonal electric field components of the circularly polarized microwave signal. Otherwise stated, the isolation means equalize the E-plane and H-plane electric field patterns of each waveguide element to produce circular polarization radiation with low circular cross-polarization level.

Preferably, each of the waveguide elements includes means as described above capable of providing conversion of a first linearly polarized microwave frequency signal to a left-hand circularly polarized microwave signal or vice versa and conversion of a second linearly polarized microwave signal to a right-hand circularly polarized microwave signal. The left-hand and right-hand circularly polarized microwave signals may be simultaneously propagated through the associated waveguide element without interference with one another, that is, with a minimum of cross polarization between the left-hand and right-hand circularly polarized signals. Thus, each of these circularly polarized signals may be operated at the same frequency, may be separately modulated to provide separate communication signals simultaneously transmitted or received, and the corresponding circularly polarized signals from each of the waveguide elements may be varied in phase and amplitude as required to achieve a desired antenna radiation pattern. To obtain this desired radiation pattern, certain of the waveguide elements in the cluster array can be dummy-loaded elements that prevent electromagnetic radiation scattering and resultant interference and, also, certain of the waveguide elements may have only left-hand or right-hand circularly polarized microwave signals transmitted through them.

The isolation means located at or near the open ends of the waveguide elements provide a substantial reduction in mutual coupling between the various waveguide elements and equalize the E-plane and H-plane electric field patterns in each waveguide element, thereby, to substantially reduce cross polarization of the electromagnetic signals propagated from or received by the waveguide elements. With the isolation achieved thereby, it now becomes possible to transmit and receive simultaneously and reliably both left-hand and right-hand circularly polarized microwave signals, each of which may have a different radiation pattern and each of which now may be isolated from one another by as much as 27 dB or more, even though the radiation patterns of the left-hand and right-hand circularly polarized signals may coincident or overlap one another. With proper control of signal amplitude and phase in the various waveguide elements, the antenna system can provide sidelobe isolation greater than 27 dB.

The isolation described in the preceding paragraph doubles the communication capacity of the available channels in the communication system with which the antenna of the invention is used. (Sidelobe isolation also doubles the communication capacity.) Where the invention is used in a satellite application, in which the available number of orbital positions for satellites is limited and satellite cost is very high, this doubling of the communication capability of a satellite is of very substantial benefit. The invention provides an additional benefit in that the primary radiation sidelobe spillover energy losses are reduced and the antenna system gain is increased.

The invention may be better understood by reference to the detailed description which follows and to the drawings.

BRIEF DESCRIPTION OF THE DRAWINGS

FIG. 3 is a diagrammatic illustration of an antenna system including an antnna waveguide element array and an offset parabolic reflector with dimensions for the illustrated antenna system pertaining to microwave transmissions in the frequency band from 3.704 GHz to 4.073 GHz;

FIG. 4 is an illustration of the open ends of waveguide elements closely clustered in the antenna array diagrammatically illustrated in FIG. 3;

FIG. 9 is an elevational view of the closely clustered antenna array shown in FIG. 8;

FIG. 10 is a partial perspective view of a portion of the open ends of the closely clustered waveguide elements in the closely clustered antenna feed array of FIG. 9;

FIG. 11 is a diagrammatic view of the scale model antenna system shown in FIGS. 8 through 10;

FIG. 13 is similar to FIG. 12 but includes measurements of the primary antenna feed horn array patterns with the waveguide elements being equipped with the isolation means;

DETAILED DESCRIPTION

Figure 1:
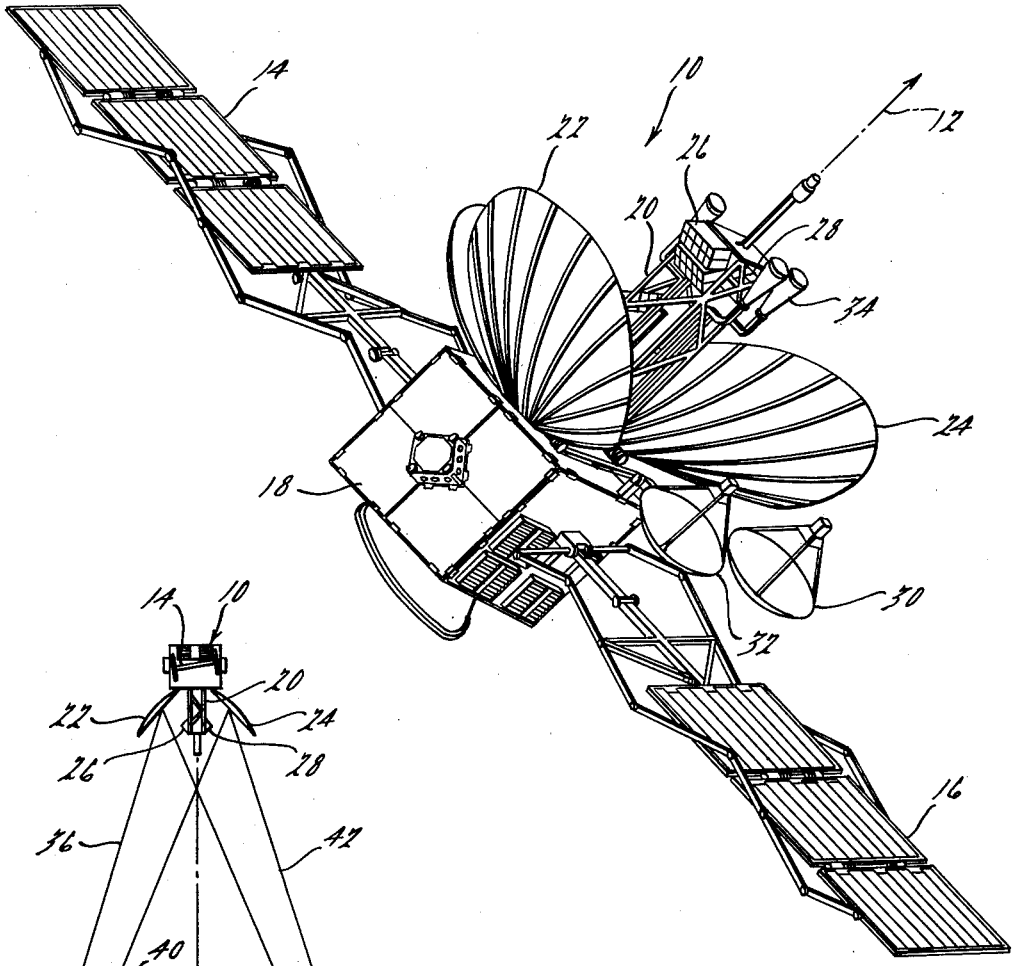
FIG. 1 is a perspective view of a satellite as it would appear when in orbit.

With reference now to the drawings, wherein like numerals refer to like parts or devices in the several views, there is shown in FIG. 1 a satellite spacecraft generally designated by the numeral 10. The satellite is pictured as it might appear when in orbit with an orbital angular velocity equal to the angular velocity of the earth. In such case, the satellite 10 is oriented such that its axis, indicated by the arrow 12, is directed at a particular point on the surface of the earth. In the description which follows with respect to antennas utilized on this satellite, it is assumed that the axis 12 is directed to a point in the Atlantic ocean such that the antenna systems on the satellite may be used to achieve communication coverage by electromagnetic waves with both the western and eastern hemispheres defined by the plane passing through the north and south poles of the earth and through the point at which the axis 12 is directed in the Atlantic ocean. Thus, the satellite provides communication coverage with a western hemisphere including Canada, the United States, Latin America and South America, whereas the eastern hemisphere includes Europe, portions of the U.S.S.R. and Africa. Of course, the satellite 10 may be used in other areas such that the axis 12 would be directed to a point in the Pacific ocean or to a point in the Indian ocean. In fact, the antenna system of the present invention is adaptable to achieve the microwave communications coverage required for satellites orbiting in positions above selected points in either the Atlantic, Pacific or Indian oceans.

The satellite 10 includes solar arrays 14 and 16 that are attached to a spacecraft body portion 18 that typically includes its guidance, attitude control, propulsion, energy storage and communications equipment. A tower assembly 20 is connected to the spacecraft body 18, as are offset elliptical parabolic reflectors 22 and 24. The parabolic reflectors 22 and 24 may have different aperture projection diameters as illustrated in FIG. 1 where the diameter of the reflector 22 is less than the diameter of the reflector 24. The offset parabolic reflector 22 is a portion of the surface of a paraboloid having a focal point located on or near the tower 20 at which a waveguide element array 26 is positioned to propagate onto the reflector 22 or to receive therefrom electromagnetic radiation at microwave frequencies. Because the antenna array 26 is positioned at a location that is offset from the reflector 22, the tower 20 and array 26 do not interfere with radiation transmitted from the earth and incident upon the reflector 22 or with radiation transmitted from the reflector 22 toward the earth. Also, opposite the array 26 on the tower 20 is a second waveguide element array 28, similar to the array 26, but perhaps of different waveguide size to accommodate a different band of microwave frequencies. The array 28 is used to propagate electromagnetic radiation toward the reflector 24 or to receive electromagnetic radiation transmitted from the earth to the reflector 24 and from there transmitted to the array 28.

In actual practice, it is intended that the waveguide element array 26 and the associated reflector 22 be used to receive transmission from either the eastern or western hemispheres of the earth, and that the antenna system including the waveguide feed element array 28 and the larger reflector 24 be used for the transmission of microwave radiation to the eastern and western hemispheres of the earth, these hemispheres being defined by the position of the axis 12 above a selected point in one of the previously mentioned ocean bodies. The principles of the invention hereinafter described and the structures illustrated are generally applicable to both antenna systems for receiving and transmitting electromagnetic radiation, but the invention is specifically described with respect to transmission from the satellite 10 to the earth's surface. Also, the satellite antenna system described in the preferred form in connection with FIGS. 2 through 7 are particularly applicable to microwave transmissions in the frequency band from 3.704 to 4.073 GHz and is described in connection with the waveguide element array 28 and the parabolic reflector 24 suitable for this frequency band. The array 26 and its associated reflector 22 may be designed for a different frequency band, for example, 5.929 to 6.298 GHz.

The satellite 10 may include various other communications equipment and antenna elements, such as those elements illustrated at 30, 32 and 34 in FIG. 1.

FIGS. 8 through 17 of this specification illustrate and describe a scale model antenna system constructed in accordance with the invention and capable of providing isolation greater than 27 dB between two microwave signals that may be of equal or different frequency, one of which has left-hand circular polarization and the other of which has right-hand circular polarization. This is a substantial improvement over the polarization isolation achievable with prior art antenna systems and permits doubling of the communication capacity from a single antenna system. Also, sidelobe secondary beam isolation greater than 27 dB is provided between the desired hemisphere or zone coverage areas and the undesired hemisphere or zone coverage areas. The invention is not only applicable to satellite communications systems employing a parabolic reflector with a waveguide element array, but may be utilized in radar or point-to-point communications systems with or without a parabolic reflector and a single waveguide element can be used to achieve similar results. The scale model antenna system was designed to operate in a frequency range from 9.07 to 9.97 GHz with a similar frequency of 9.54 GHz in this frequency band.

Preferably, the reflectors 22 and 24 are made of graphite-fiber-reinforced plastic (hereinafter GFRP) construction and are coated with a vacuum-deposited aluminum surface of seven micrometers in thickness, a thickness greater than 5 skin depths.

Figure 2:
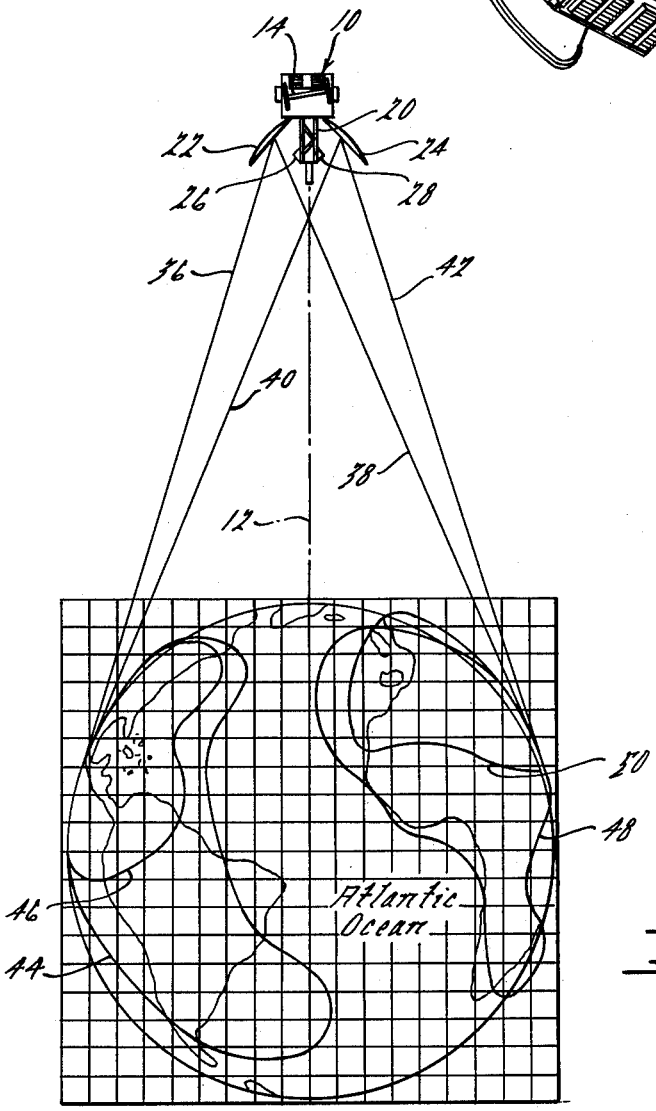
FIG. 2 is a perspective view of the satellite of FIG. 1 illustrating its relationship to the earth and the radiation patterns that may be transmitted from it to the earth or received by it from earth transmitting stations.

With particular reference now to FIG. 2, there is shown the satellite 10 having the receiving antenna system including the waveguide element feed array 26 and its associated reflector 22 and the satellite transmitting antenna system including its waveguide element feed array 28 and associated larger diameter offset parabolic reflector 24. Below the satellite is shown a diagrammatic representation of the earth with the satellite axis 12 being directly over the Atlantic ocean. Diagrammatically illustrated in this earth portion are, on the left in FIG. 2 and representing the western hemisphere, the North and South American continents. To the right and representing the eastern hemisphere are the European and African continents. Lines 36 and 38 from the reflector 22 indicate the reception region accessible by this reflector and its associated waveguide element receiving array 28. Similarly, lines 40 and 42 define the transmission area for the antenna system on the satellite 10 including the waveguide element feed array 28 and its associated reflector 24.

With regard to the satellite 10 transmitting antenna system including components 28 and 24, there is shown in FIG. 2 a western hemisphere antenna transmission pattern 44 and a second transmission pattern 46 of smaller size than the pattern 44. Although the satellite antenna transmission pattern 46 could be of identical shape and size as the pattern 44, it is preferred to have a smaller pattern such as 46 to provide a strong zonal radiation pattern for a highly congested region of the North American continent, that is, the Atlantic seaboard area in the north and the Latin American and northern South American areas. In the eastern hemisphere, the satellite transmitting antenna formed by components 28 and 24 provide antenna radiation patterns 48 and 50, the former again being larger than the latter and covering the European and South American continents. The smaller zonal area 50 covers the European and North African regions.

The satellite transmission radiation patterns 44, 46, 48 and 50 in FIG. 2 illustrate the strong signal regions. It should be understood, however, that the antenna does radiate sidelobe patterns that cover both the eastern and western hemispheres, but with appropriate antenna design these sidelobe radiation patterns are very substantially below the power levels in the indicated radiation pattern areas. This sidelobe isolation permits reuse in the respective hemispheres of a given frequency channel. However, until now, it has not been possible to use the same frequency channel simultaneously to produce the separate radiation patterns 44 and 46 or 48 and 50 which would not interfere with one another. With the present invention, this has become possible and has been accomplished through the generation of antenna microwave electromagnetic transmissions as follows:

| Parameter | 4 GHz Hemisphere Patterns 44 and 48 | 4 GHz Zonal Patterns 46 and 50 |
|---|---|---|
| Frequency (GHz) | 3.704 to 4.073 | 3.704 to 4.037 |
| Polarization | Right-Hand Circular Polarization | Left-Hand Circular Polarization |
| Minimum Coverage Gain | 22 dBi | 25 dBi |
| Gain Variation (dB/0.4°) | 1.2 | 1.2 |
| Voltage Axial Ratio | Less than 1.09 | Less than 1.09 |
| Isolation (dB) | Greater than 27 | Greater than 27 |

The receiving antenna components 26 and 22 on the satellite 10 have similar hemispherical and zonal radiation patterns as indicated above, but the receiving antenna is intended to operate in the frequency range from 5.929 to 6.298 GHz with left-hand circular polarization for the hemispherical radiation patterns and right-hand circular polarization for the zonal radiation patterns. The above satellite antenna performance specifications and patterns are based upon test results achieved with the previously-mentioned earth scale model antenna system operating from 9.07 to 9.97 GHz, as hereinafter described, but the results therewith are expected to be directly indicative of satellite antenna performance in the lower frequency bands indicated above.

In FIG. 3, there is shown a diagrammatic view of the antenna feed array 28 and its relationship to the parabolic reflector 24, which is elliptical in shape and which has a surface that is a part of a paraboloid having a focal point located at 54 on the axis 52. Microwave electromagnetic radiation propagated from the antenna feed array 28 reflects from the parabolic reflector 24, offset from the axis 52, as indicated at 56, 28 and 60, toward the earth.

Figure 5:
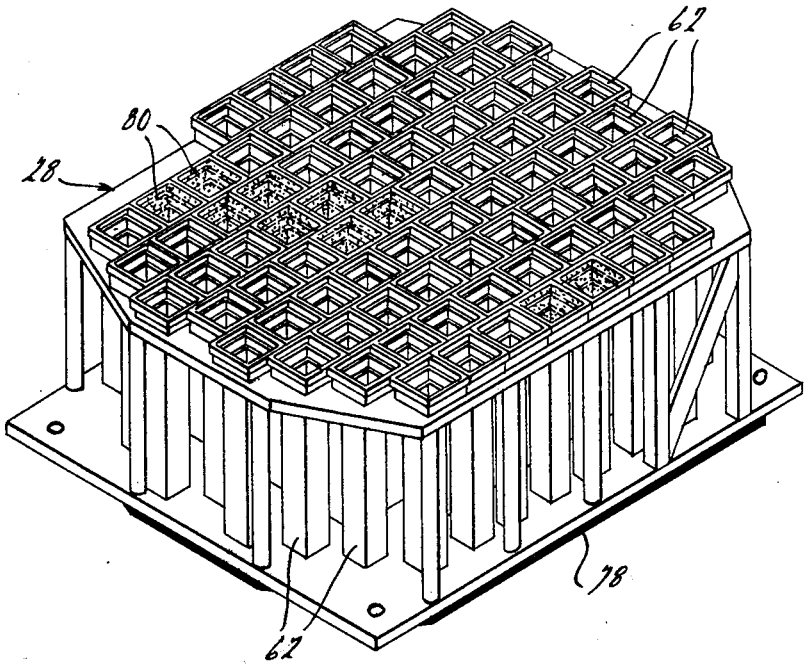
FIG. 5 is a perspective drawing of the preferred form of the closely clustered antenna array illustrated in FIG. 4 and includes the support structure that may be utilized therewith.
Figure 6:
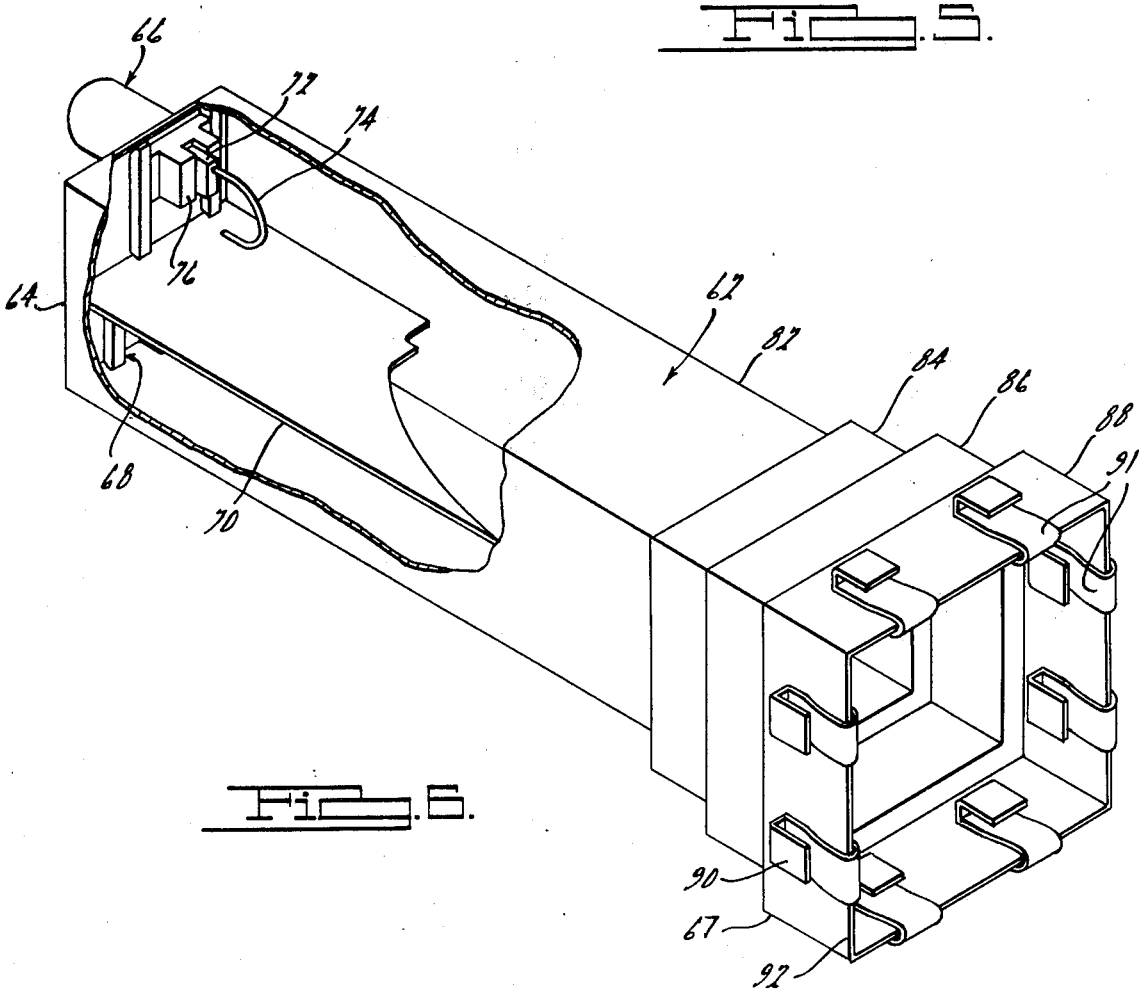
FIG. 6 is a perspective drawing of the preferred form of a waveguide element that preferably constitutes one of the plurality of such elements illustrated in the closely clustered antenna array of FIGS. 4 and 5.

With reference now to FIGS. 4 through 7, there are shown various views of the antenna feed array 28 and of the waveguide elements used in this array. FIG. 6 is a perspective view of an entire waveguide element 62, a plurality of such waveguide elements together with its support structure forming the antenna feed array 28 illustrated in plan view in FIG. 4 and in perspective view in FIG. 5. Since the antenna feed array 28 is to be used as a satellite transmission antenna as previously indicated, the waveguide elements 62 each include an input end 64 and an output end 67, the latter being in communication with free space through which microwave radiation is to be transmitted toward the earth.

The input end 64 of the square waveguide element 62 includes a first input means 66 adapted for connection to a coaxial transmission line and a second input means 68, identical to the first means 66, adapted for connection to a second coaxial transmission line. A first microwave signal may be applied via the coaxial line connected to the first input means 66 and a second microwave signal, identical in frequency to the first microwave signal if desired, may be supplied via the second coaxial transmission line to the second input means 68. A septum polarizer 70 produces right-hand circular polarization of the first microwave signal applied to the first input means 66 and left-hand circular polarization of the second microwave signal applied to the second input means 68. Each of the input means 66 and 68 includes conductive central element 72, having a conductive hook-shaped element 74, that is electrically connected to the center conductor of the respective coaxial cable (not shown). The conductive elements 72 and 74 are insulated from the interior of the waveguide element 62 by dielectric support means 76. Also, the outer portion of the input means 66 and 68 on the exterior of the waveguide element 62 may be formed from a conductive material for direct connection to the outer conductors of the respective coaxial cables. However, the input means 66 and 68 may be directly connected, and preferably are so connected, to openings in a printed circuit transmission line assembly 78 (FIG. 5) that may be used to supply the feed for the entire array 28 of waveguide elements 62.

The septum polarizer 70 is the subject of patent application Ser. No. 808,206 filed June 20, 1977 and entitled "Balanced Phase Septum Polarizer". The input means 66 and 68 is the subject of patent application Ser. No. 732,688 filed Oct. 15, 1976 and entitled "Apparatus for Coupling Coaxial Transmission Line to Rectangular Waveguide". These commonly assigned applications were filed in the name of Harry J. Gould, one of the present inventors.

Linearly polarized microwave signals are transferred to the waveguide elements 62 by the hook-shaped conductors 74 of the first and second input means 66 and 68. The septum polarizer 70 transforms these linearly polarized microwave signals to a first microwave signal having left-hand circular polarization and a second microwave signal having right-hand circular polarization. As nearly perfect as possible left-hand and right-hand circular polarization within the waveguide element 62 is desirable to minimize interference between these simultaneously transmitted microwave signals, which may be at the same frequency, thereby doubling the capacity of the waveguide element feed array 28. The printed circuit board transmission line assembly 78 preferably includes power dividers, attenuators, switching elements, and phase shift circuitry to permit energization of the various waveguide elements 62 at different power levels and in different phase relationships and to permit energization of selected groups of the waveguide elements 62, which collectively permits the feed array 28 to generate the hemispherical and zonal patterns previously described in connection with FIG. 2. Also, various dummy waveguide elements 80, having resistive load terminations and preferably having no signal input, may be used to absorb electromagnetic energy and to prevent electromagnetic energy from scattering upon the feed array.

FIG. 4 illustrates the manner in which the various waveguide elements 62 and dummy waveguide elements 80 may be grouped to obtain zonal and hemispherical radiation patterns, such as those disclosed in connection with FIG. 2, for satellites having their axes 12 positioned above selected points in the Indian, Atlantic and Pacific oceans. In other words, the waveguide elements in FIG. 4 may be selectively energized with appropriate amplitude and phase relationships that permit modification of the radiation patterns propagated from the parabolic reflector 24 toward the earth so that the satellite 10 may be moved from a position, for example, over the Atlantic ocean to a position over either the Indian ocean or the Pacific ocean and still obtain from the antenna system zonal and hemispherical radiation patterns suitable for the new satellite position. In order to obtain the required modification of the radiation patterns when the satellite 10 is moved from one ocean location to another, the printed circuit board transmission line assembly 28 may incorporate various switching elements required to obtain the waveguide element energization groupings, such as illustrated in FIG. 4, necessary for the satellite utilization area.

Figure 7:
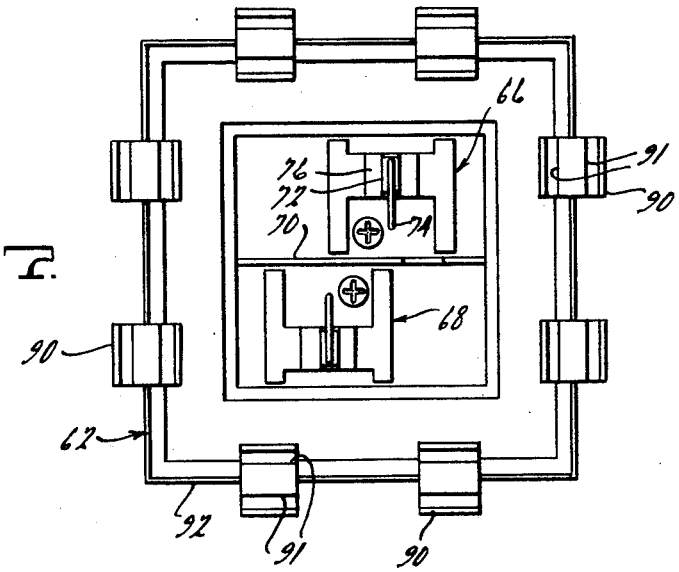
FIG. 7 is an elevational view of the open end of the waveguide element of FIG. 6, the end of the waveguide element that communicates with free space through which electromagnetic radiation is propagated or from which such radiation is received, and illustrates isolation means positioned at or near such open end to equalize orthogonal electric field components and to prevent mutual coupling between the various waveguide elements in the closely clustered antenna feed array.

With particular reference now to FIGS. 6 and 7, it may be seen that the waveguide element 62 has portions 82, 84, 86, and 88, each of which portions are of square cross-section. With respect to the inner dimensions of the waveguide element 62, it is preferred that the sides of the portion 82 have a dimension approximately equal to 0.625 lambda where lambda is the wavelength of the center frequency to be transmitted through the waveguide element 62. Similarly, it is preferred that the interior dimension of each side of the portion 88 of the waveguide element 62 be approximately equal to 1.13 lambda. The waveguide elements portions 84, 86, and 88 form a step transformer that enlarges the radiation pattern propagated from the open end 67 portion of the waveguide element 62. For the purpose of obtaining a light weight waveguide element construction, it is preferred that this element be fabricated from graphite-fiber reinforced plastic having an internal conductive coating, that may be vapor deposited thereon, of copper and perhaps also having a gold flash over the copper.

Each of the waveguide elements 62 includes isolation means located at or near the open end 67. Preferably, this means comprises a plurality of discriminating mode compensators 90. In the presently preferred form of this isolation means, each of the discriminating mode compensators 90 comprises a symetrical, conductive spring tab having U-shaped portions 91 located on both the interior and exterior sides of the portion 88 of the waveguide element 62. Preferably, the tabs 90 are made from a conductive metal material, are attached at or near the edge 92 of the portion 88 of the waveguide element 62 and total 8 in number associated with each of the waveguide elements 62. Two of these eight are attached to each side of the square portion 88. The spacing and relative dimensions of the tabs 90 preferably are scaled relative to the size of the portion 88 in the manner illustrated in FIGS. 6 and 7. Also, the tabs 90 may be very thin and in the preferred form have a thickness of about 0.01 mm, this thickness being exaggerated in FIGS. 6 and 7 for clarity. Also, it should be understood that where the waveguide elements are clustered as shown in FIG. 5, the tabs 90 forming the isolation means in general are associated with more than one of the waveguide elements 62, that is, most of the tabs 90 are attached to abutting sides of the portions 88 of adjacent waveguide elements 62.

The isolation means or tabs 90 can be regarded as discriminating mode compensators that serve two functions: they reduce mutual coupling among the waveguide elements and they tend to equalize the orthogonal E-plane and H-plane electric field patterns of the circularly polarized radiation transmitted through each of the waveguide elements, thus producing radiation patterns of low cross-polarization. The reduction of mutual coupling among waveguide elements may be due to a multi-path process in which electromagnetic energy coupled across regions between the tabs 90 is out of phase relative to electromagnetic energy coupled across the tabs. This would produce field cancellation and result in reduced mutual coupling. The equalization of the E-plane and H-plane electric field components is due to the generation of $TE/TM_{12}$ and $TE/TM_{21}$ modes and reduction of the cross-polarization component within the waveguide. These higher order modes modify the $TE_{10}$ and $TE_{01}$ mode aperture distribution and tend to equalize the E-plane and H-plane electric field patterns.

The tabs 90 provide isolation means or act as discriminating mode compensators to prevent mutual coupling between the microwave energy emitted or, in the case of a receiving antenna, received at the open end 67 of one waveguide element with corresponding radiation associated with the open end of other waveguide elements 62 in the transmitting antenna array 28 or in the receiving array 26. Undesirable mutual coupling between the various waveguide elements in the arrays produces cross-polarization of undesirably high levels in the left-hand and right-hand simultaneously transmitted or received microwave signals associated with the transmitting and receiving antenna structures. With the isolation means herein described on the waveguide elements 62, the inventors have obtained, in the scale model antenna system hereinafter described, simultaneously transmitted and received left-hand and right-hand circularly polarized microwave signals having cross-polarization interference isolation of greater than 27 dB. This is a very substantial improvement over prior art antenna systems and now permits the communication capacity of a satellite to be doubled over that previously available due to the high level of isolation possible when identical or different microwave frequencies are simultaneously transmitted or received by an antenna characterized by signals having isolated left-hand and right-hand noninterfering circular polarizations.

Figure 8:
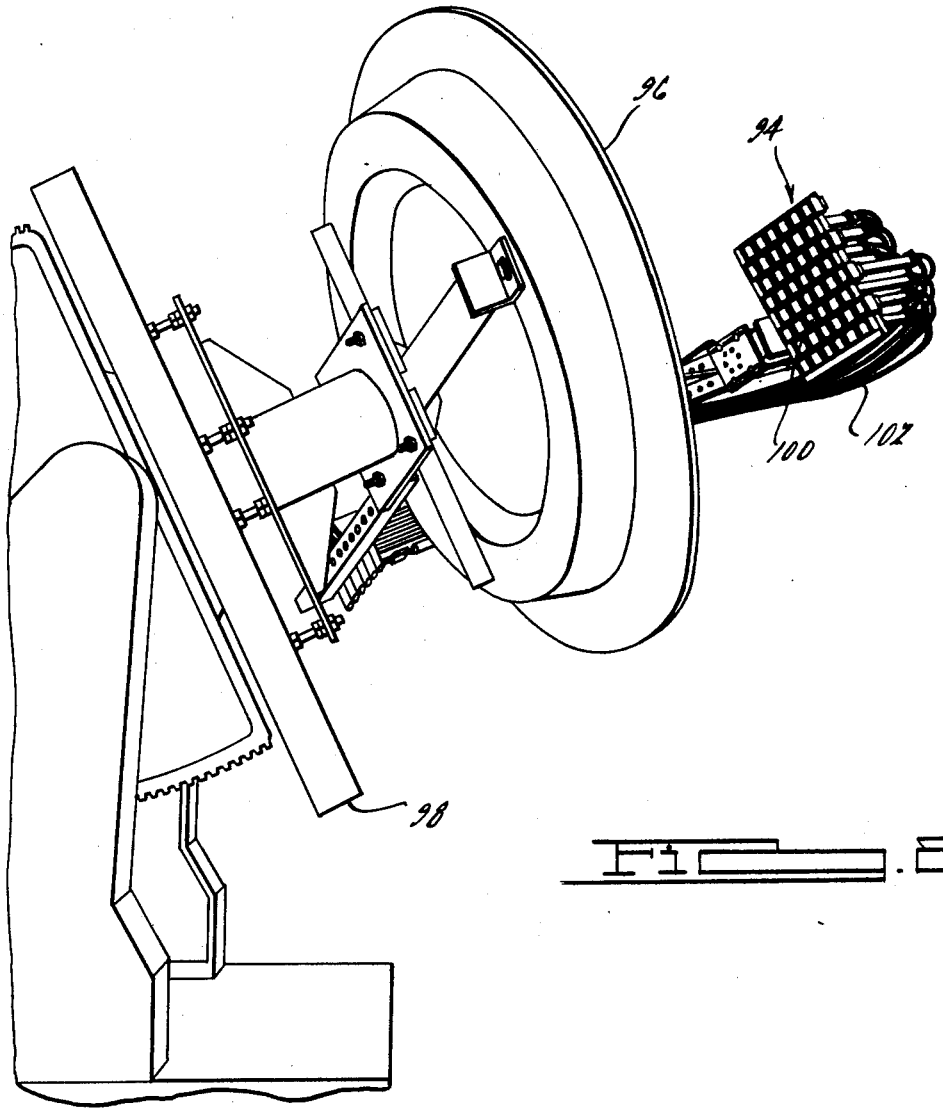
FIG. 8 is a perspective view of a scale model of an antenna constructed in accordance with the invention.

With particular reference to FIGS. 8 through 10, there is shown apparatus utilized on earth in reducing to practice the present invention in a microwave frequency band of from 9.07 to 9.97 GHz. This frequency band was selected to permit the use of an existing offset parabolic reflector 96, in association with a waveguide element feed array 94, positioned at the focal point of the parabolic reflector 96, having waveguide elements 100, each of which is generally similar to that illustrated in FIG. 6, but which are formed from metal and which have the transformer portions at the open ends of each element formed as a single piece. Each of the waveguide elements 100 also are smaller in size than are the waveguide elements 62 illustrated in FIG. 6 for the 4 GHz band due to the higher frequency employed in the scale model. The waveguide elements 100 are fed through their input ports by coaxial cables 102 connected to a suitable power divider, attenuator, phase shift and switching apparatus not shown in the drawings. The parabolic reflector 96 is mounted upon an apparatus 98 permitting variations in the elevation of the parabolic axis relative to the ground plane. An elevational view of the feed array 94 is shown in FIG. 10 and includes isolation means in the form of tabs 104, similar to those previously described but of smaller size to accommodate the smaller waveguide element size required in the 9 GHz frequency band employed in the scale model.

FIG. 10 is a perspective view of a portion of the lower right-hand section of the feed array illustrated in FIG. 9.

FIG. 11 is a diagrammatic view which illustrates the dimensions used in the scale model depicted in FIGS. 8 through 10. The axis 106 of the paraboloid of which the parabolic reflector 96 is a portion passes through the focal point at which the mutually perpendicular axes X', Y' and Z' are located.

FIGS. 12 through 17 graphically illustrate a portion of a considerable amount of data that has been accumulated with the scale model antenna system. This data is believed to be representative of the antenna system operation.

Figure 12:
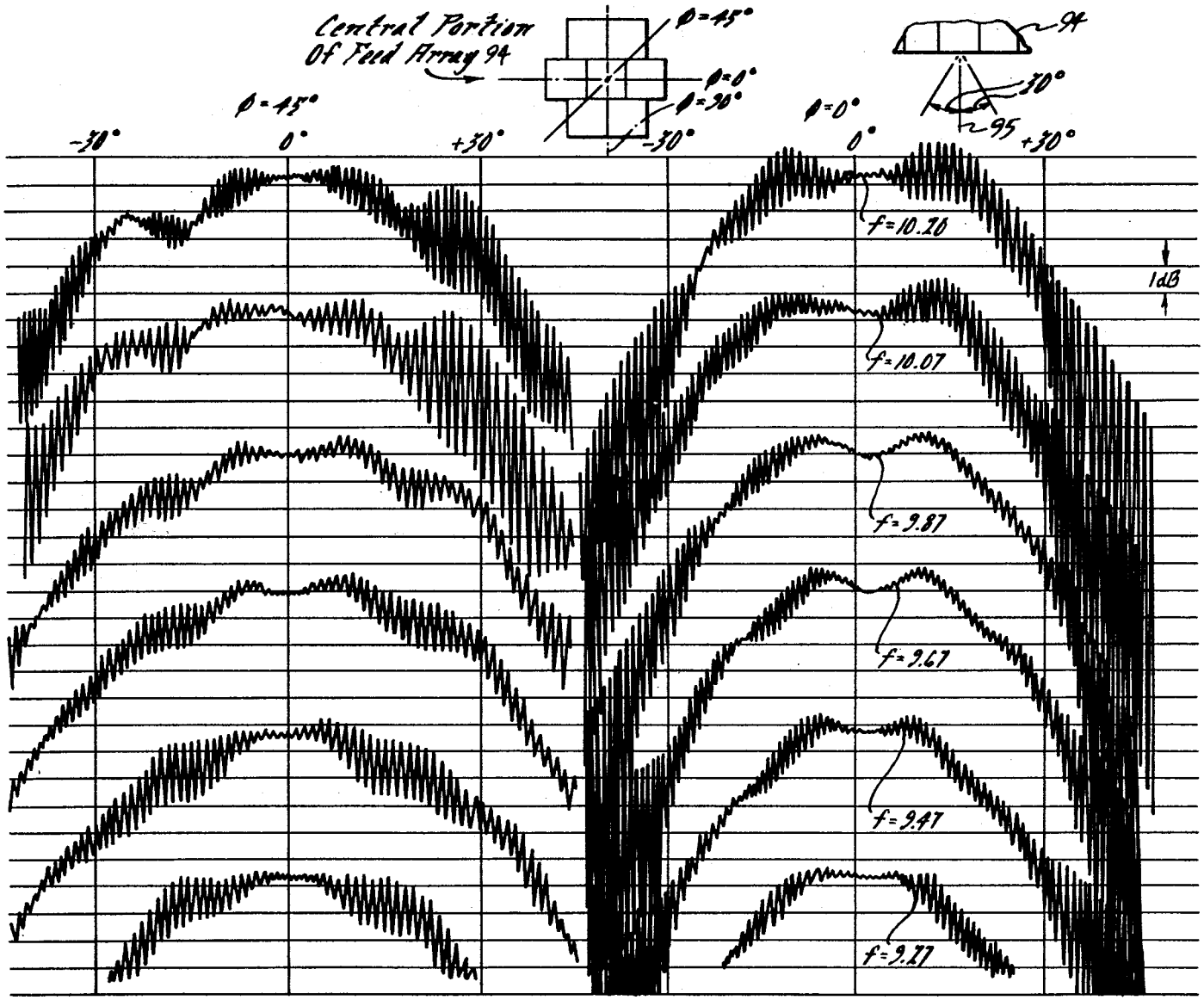
FIG. 12 is a graph illustrating, at various frequencies, the primary antenna array radiation patterns measured in 0° and 45° planes with the antenna array being used without the isolation means previously mentioned.

In particular, FIG. 12 illustrates for six specific frequencies, from 9.27 to 10.20 GHz, the primary radiation patterns of a single waveguide element in the antenna feed array 94. These patterns are primary in the sense that they are measured without the presence of the offset parabolic reflector 96 and the patterns in FIG. 12 apply to the single waveguide element operating in the absence of the tabs 104 illustrated in FIGS. 9 and 10. In the upper center portion of FIG. 12, there is shown an elevational view of the central portion of the feed array 94. It should be noted that there are three axes, identified as $\phi = 0°$, $\phi = 45°$, $\phi = 90°$. These three coplanar lines intersect at the X' - Y' axes of the feed array 94. These intersecting $\phi$ lines represent the edges of planes extending out of the drawing of FIG. 12 and located within the radiation pattern of the feed array. To the right of this diagrammatic elevational view in FIG. 12, there is shown a plan view of the feed array 94. A line 95 is shown extending from the feed array 94 in the direction of radiation propagation at an elevational angle of 0°. On either side of the line 95, there are two lines representing elevational angles of, respectively, ±30° from the 0° elevational line 95.

The radiation pattern illustrated on the right in FIG. 12, for measurements made in the plane where $\phi = 0°$, are based upon measurements of the axial ratio made by measuring continuously the axial ratio extending along a radial cut through the radiation pattern, that is, by measuring the axial ratio for elevational angles extending from −45° to +45°. Similarly, measurements at frequencies corresponding to those on the right in FIG. 12 are illustrated on the left for the plane $\phi = 45°$ again for a radial cut extending from elevational angles of −45° to +45°.

Figure 14:
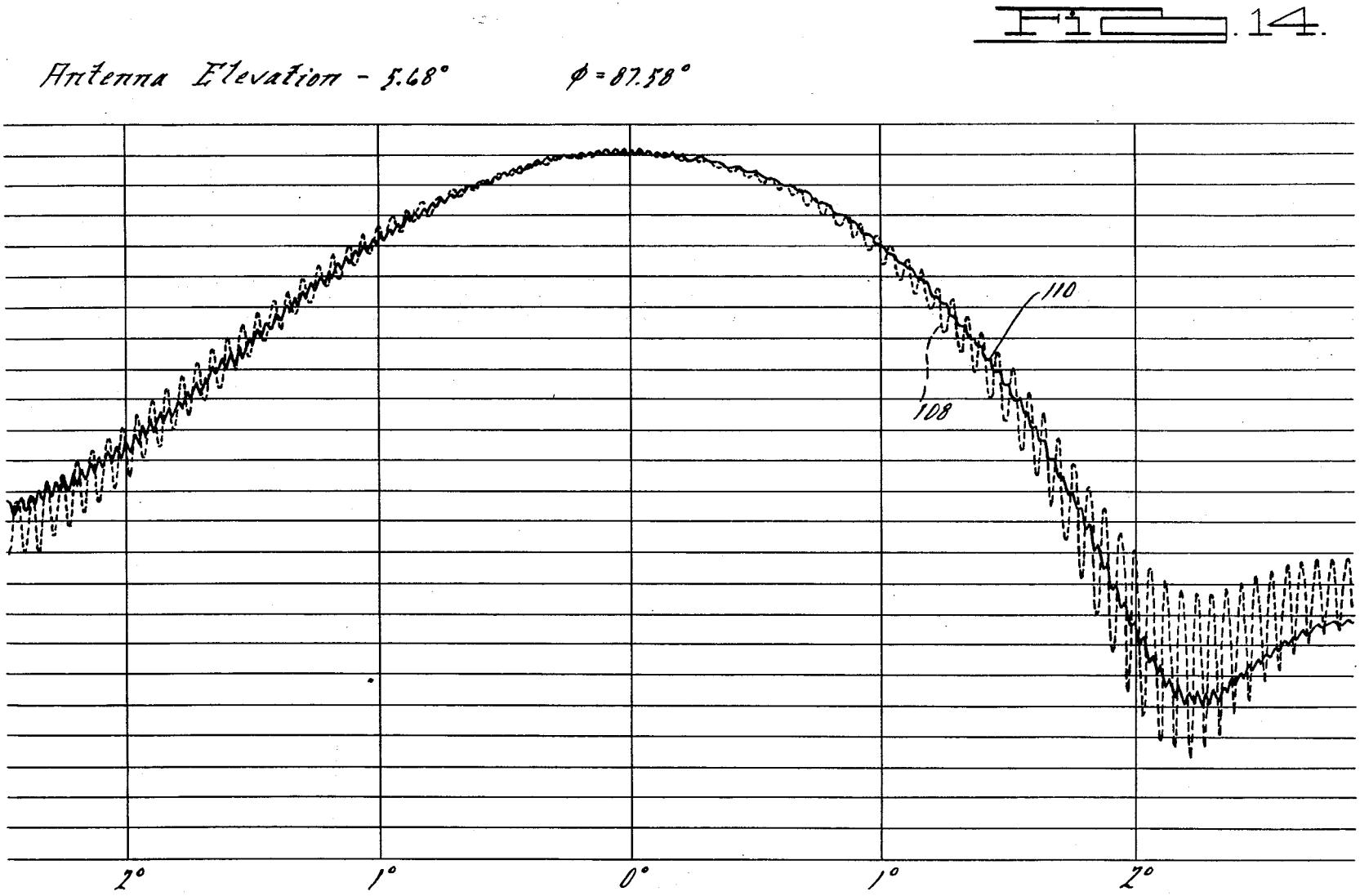
FIG. 14 is a graph illustrating secondary antenna patterns, patterns obtained from the offset parabolic reflector illustrated in the scale model antenna system of FIGS. 8 through 11, showing both the pattern obtained with the isolation means on the waveguide elements and the pattern obtained without such isolation means thereon.

The horizontal lines in FIGS. 12, 13, and 14 are separated by 1 dB and are used to indicate the difference between the minimum and maximum values of the oscillatory variation depicted in the various radiation patterns. The oscillatory patterns result from the measurement of the electric field components in the radiation transmitted from a continuously rotating and linearly polarized source to the feed array 94. As a result of this rotational measurement of the linear electric field components in the radiation pattern of the antenna, it is possible to determine the degree of departure from perfect circular polarization. A cross-polarization isolation specification of 27 dB corresponds to a power axial ratio of 0.75 dB and to an actual power axial ratio of 1.188. Similarly, a voltage or electric field axial ratio of 27 dB corresponds to an actual voltage axial ratio of 1.09. Otherwise stated, the cross-polarization isolation in dB is equal to 20 log $[(1.09 - 1)/(1.09 + 1)]$.

FIG. 13 is similar to FIG. 12 with respect to that data which it depicts except that two additional frequencies are included in the radiation patterns, extending from 8.87 to 10.20 GHz and the data applies to a single energized waveguide element in the feed array 98 with the tabs 104, illustrated in FIGS. 9 and 10, attached to the waveguide elements. From FIG. 13, the substantial reduction in voltage axial ratio, essentially determined by the peak-to-peak variation of the oscillatory patterns in FIG. 13, should be noted. FIG. 12 illustrates axial ratios in the range of from 3.6 to 5.6 dB, whereas the dramatic improvement achieved with the tab 104 isolation means, which also provide equalization of the electric field intensities of the orthogonal electric fields perpendicular to the direction of propagation in the waveguide elements, is apparent in FIG. 13 where the power axial ratio clearly is far less than in FIG. 12.

FIG. 14 illustrates two secondary radiation patterns 108 and 110 obtained from the feed array 94 using a single waveguide element. These are secondary radiation patterns in that they are measured with a beam reflected from the offset parabolic reflector 96 illustrated in FIG. 8. The angular designation at the bottom portion of FIG. 14 represents departures from a nominal 5.68° elevational angle, the 0° designation representing this angle. The patterns again were measured with a continuously rotating and linearly polarized source for sensing the electrical field intensities in the radiation pattern and were made at an angle of $\phi = 87.58°$, which indicates the plane in which the measurements were made.

Figure 17:
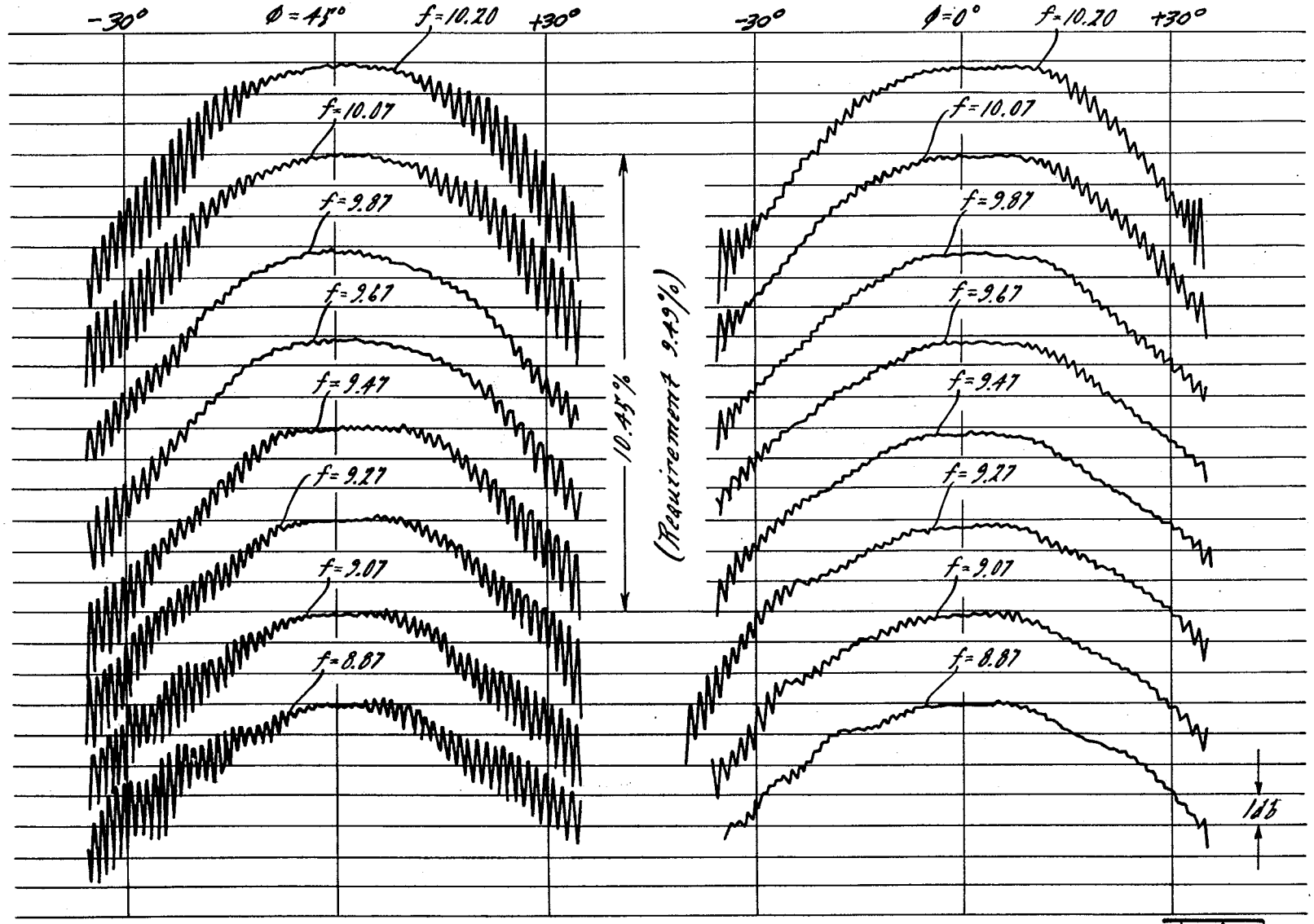
FIGS. 16 and 17 illustrate, respectively, the principal and cross-polarization radiation patterns achieved by the scale model antenna of FIGS. 8 through 11 at a frequency of 9.54 GHz.
Figure 15:
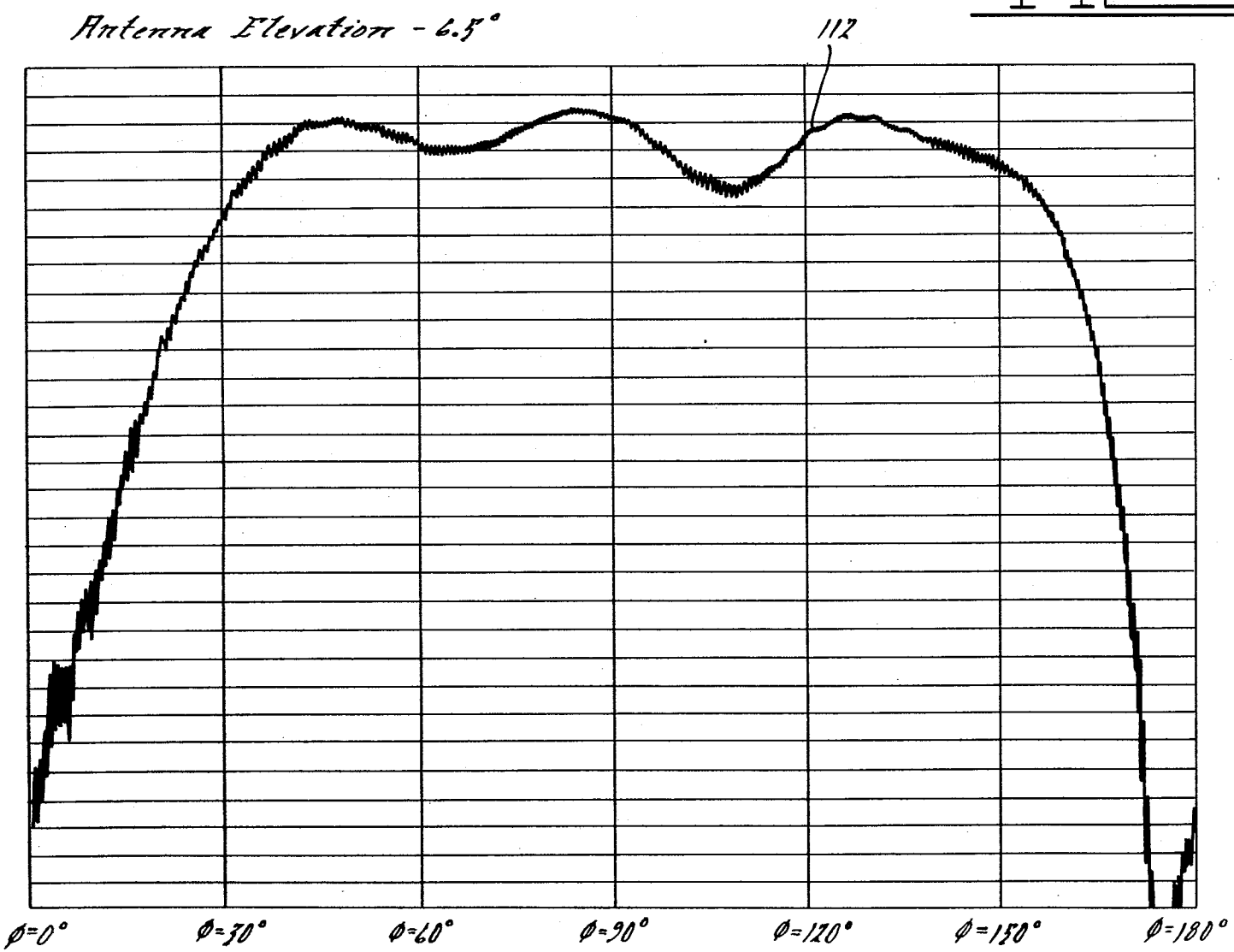
FIG. 15 is a graph illustrating the secondary pattern power radiation from the scale model antenna system of FIGS. 8 throgh 11 for a right-hand circular polarization microwave signal supplied by the antenna feed array and reflected from the offset parabolic reflector.
Figure 16:
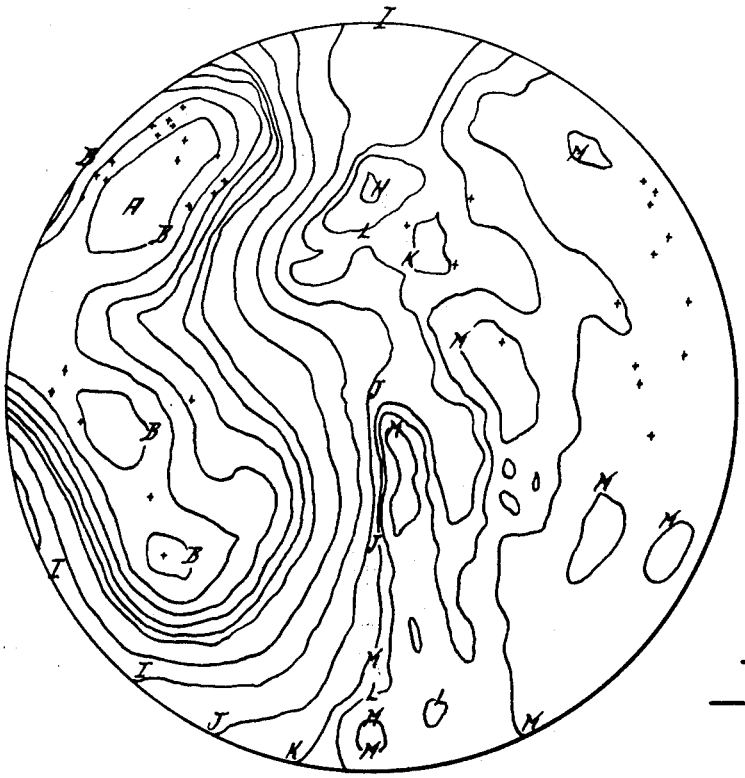
Figure 17:
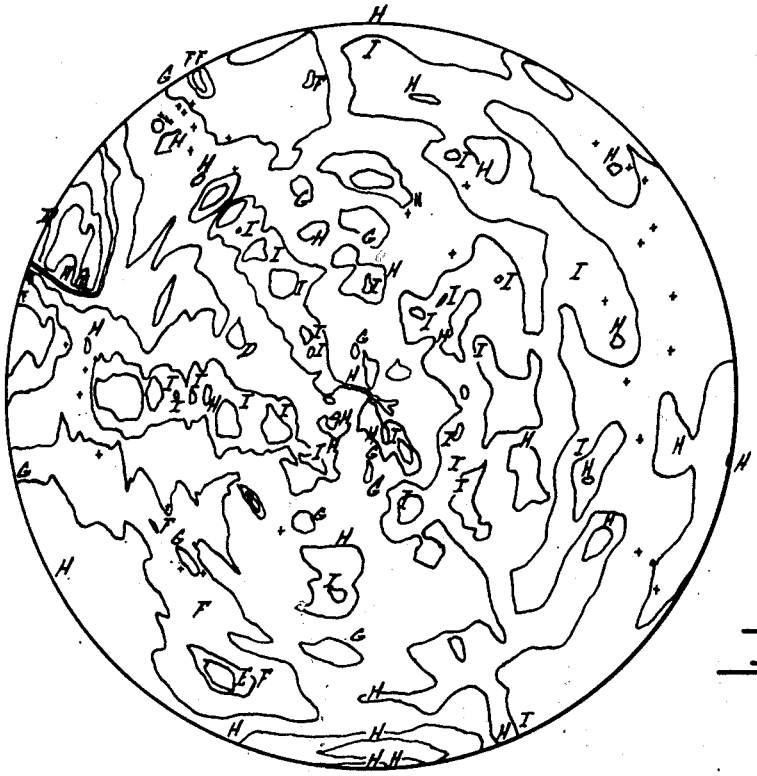

With particular reference now to FIG. 15, there is shown a representative secondary radiation pattern measured on the complete 25 element feed array 94 with a hemispherical radiation pattern such as might be used with an Indian ocean satellite location. The radiation pattern is for right-hand circular polarization and the measurements are applicable to conical cuts through the radiation pattern, that is, cuts made at a fixed radius from the intersection of the $\phi$ lines illustrated in FIG. 12 and continuously through the various planes from $\phi = 0°$ to $\phi = 180°$. The consistently low axial ratio achieved should be noted. The radiation pattern measurements illustrated in FIG. 15 and many other similar measurements were made at the center frequency for the scale model antenna of 9.54 GHz. Data was accumulated and processed by a computer. This computer processed data was used to generate principal and cross-polarization patterns for the entire earth's surface. FIGS. 16 and 17 show such data up to elevation angles of 9°. FIG. 16 illustrates the principal polarization data and it can be seen that the radiation pattern in the left-hand portion of the diagram of FIG. 16 is greater than 27 dB above that in the right-hand or eastern hemisphere portion of FIG. 16. Similarly, FIG. 17 illustrates the cross-polarization isolation radiation patterns over the entire earth's surface. The cross-polarization isolation for the antenna system can be calculated by subtraction of the power levels of FIG. 16 from those of FIG. 17 at corresponding locations in the coverage area. It can be seen that cross-polarization isolation greater than 27 dB is achieved substantially throughout the radiation pattern for a left-hand or western hemisphere.

In FIG. 9, the waveguide elements have relative amplitude and phase angle designations that result in the radiation patterns of FIGS. 16 and 17. The graphs of FIGS. 12 through 14 apply to radiation received by waveguide element 15 of FIG. 9.

Based upon the foregoing description of the invention, what is claimed is:

1. A microwave antenna, which comprises at least one waveguide element, said waveguide element including means for permitting both left-hand and right-hand circularly polarized microwave signals to be transmitted therethrough and said waveguide element having an open end, and means, attached at or near said open end, for equalizing the intensity of the orthogonal electric field components, perpendicular to the direction of propagation, of said left-hand circularly polarized microwave signal and for equalizing the intensity of the orthogonal electric field components, perpendicular to the direction of propagation, of said right-hand circularly polarized microwave signal.

2. A microwave antenna system, which comprises a plurality of waveguide elements, each of said waveguide elements including means for permitting both left-hand and right-hand circularly polarized microwave signals to be transmitted therethrough, said left-hand circularly polarized microwave signal having orthogonal electric field components rotating in a plane perpendicular to the direction of propagation of said left-hand circularly polarized signal, said right-hand circularly polarized signal having orthogonal electric field components rotating in a plane perpendicular to the direction of propagation of said left-hand circularly polarized signal and rotating in a direction opposite to the rotational direction of said orthogonal electric field components of said left-hand circularly polarized microwave signal, and each of said waveguide elements having an open end, and means, attached at or near said open end, for equalizing said orthogonal electric field components, perpendicular to the direction of propagation, of said left-hand circularly polarized microwave signal and for equalizing the intensity of said orthogonal electric field components, perpendicular to the direction of propagation, of said right-hand circularly polarized microwave signal.

3. A microwave antenna system, according to claim 2, wherein said means for equalizing said electric field components prevents mutual coupling of said circularly polarized microwave signals, transmitted through one of said waveguide elements, with said circularly polarized microwave signals transmitted through other of said waveguide elements.

4. A microwave antenna system which comprises: a plurality of waveguide elements, each of said waveguide elements having first and second ports, means for converting a first linearly polarized microwave signal at one of said ports to or from a left-hand circularly polarized microwave signal within said waveguide element and for converting a second linearly polarized signal at the other of said ports to or from a right-hand circularly polarized microwave signal, each of said waveguide elements having an end, separated from said first and second ports by said converting means, said waveguide element end being in communication with free space, thereby, to permit circularly polarized microwave electromagnetic radiation to be transmitted from or received by said waveguide element end, and said waveguide element end having associated with it isolation means for reducing mutual coupling of circularly polarized microwave radiation associated with one of said waveguide elements with such circularly polarized microwave radiation of other of said waveguide elements.

5. An antenna system according to claim 4, wherein said isolation means comprises a plurality of tabs.

6. A microwave antenna system, according to claim 4, wherein said isolation means comprises a plurality of tabs having at least two U-shaped portions, said tabs being attached at or near said waveguide element end of a plurality of said waveguide elements.

7. A microwave antenna system, according to claim 4, wherein each of said waveguide elements is of square cross-section in the region thereof between said converting means and said waveguide element end.

8. A microwave antenna system, according to claim 7, which includes a step transformer in each of said waveguide elements, said step transformer in each of said waveguide elements being positioned between said converting means therein and said waveguide element end.

9. A microwave antenna system, according to claim 8, wherein said isolation means associated with said waveguide element end of each of said waveguide elements comprises eight tabs, said square cross-section waveguide element portion having two of said tabs positioned at said waveguide element end, within the interior of said waveguide element end, and having two of said tabs located on each of the four sides of said square waveguide element region.

10. A microwave antenna system, which comprises: a plurality of waveguide elements, each of said waveguide elements having first and second ports and an end spaced, via the microwave transmission path, from said ports, means for converting a first linearly polarized microwave signal at one of said ports to or from a left-hand circularly polarized microwave signal within said waveguide element and for converting a second linearly polarized microwave signal to or from a right-hand circularly polarized microwave signal, each of said microwave signals having orthogonal electric field components perpendicular to its direction of propagation, the orthogonal electric field components of said left-hand circularly polarized signal having a resultant electric field rotating in a first direction, the orthogonal electric field components of said right-hand circularly polarized microwave signal having a resultant electric field rotating in a second direction, and means, attached at or near said waveguide element end, for equalizing the intensity of the orthogonal electric field components of said left-hand circularly polarized microwave signal and for equalizing the intensity of the orthogonal electric field components of said right-hand circularly polarized microwave signal.

11. A microwave antenna system, according to claim 10, wherein said means for equalizing the intensity of said electric field components prevents mutual coupling of said circularly polarized microwave signals, transmitted through one of said waveguide elements, with said circularly polarized microwave signals transmitted through other of said waveguide elements.

* * * * *